US006516854B1

(12) United States Patent
Tsai

(10) Patent No.: US 6,516,854 B1
(45) Date of Patent: Feb. 11, 2003

(54) AUTOMATIC LABEL-STICKING DEVICE FOR OPTICAL DISC DRIVE

(75) Inventor: Meng-Chi Tsai, Jongli (TW)

(73) Assignee: Behavior Tech Corporation, Taipei (TW)

( * ) Notice: Subject to any disclaimer, the term of this patent is extended or adjusted under 35 U.S.C. 154(b) by 0 days.

(21) Appl. No.: 09/716,423

(22) Filed: Nov. 21, 2000

(51) Int. Cl.[7] ..... B65C 9/00; B65C 9/08; B65C 9/18

(52) U.S. Cl. ..... 156/542; 156/361; 156/541; 156/DIG. 24; 156/DIG. 33

(58) Field of Search ..... 156/541, 542, 156/360, 361, 362, 363, DIG. 24, DIG. 33

(56) References Cited

U.S. PATENT DOCUMENTS

| | | | | | |
|---|---|---|---|---|---|
| 3,321,105 | A | * | 5/1967 | Marano | 221/22 |
| 3,428,509 | A | * | 2/1969 | Messmer | 156/361 |
| 3,682,743 | A | * | 8/1972 | Cleary et al. | 156/384 |
| 4,294,644 | A | * | 10/1981 | Anderson | 156/361 |
| 4,432,830 | A | * | 2/1984 | Jue | 101/288 |
| 4,581,094 | A | * | 4/1986 | Sato | 156/352 |
| 4,770,736 | A | * | 9/1988 | Taylor et al. | 156/238 |
| 4,867,833 | A | * | 9/1989 | McCoy | 156/361 |
| 5,256,239 | A | * | 10/1993 | Voltmer et al. | 156/362 |
| 5,300,181 | A | * | 4/1994 | Yamaguchi | 156/542 |
| 5,938,890 | A | * | 8/1999 | Schlinkmann et al. | 156/541 |

FOREIGN PATENT DOCUMENTS

JP 10273124 A * 10/1998 ..... B65C/9/46

* cited by examiner

*Primary Examiner*—Richard Crispino
*Assistant Examiner*—Sue A. Purvis
(74) *Attorney, Agent, or Firm*—Rosenberg, Klein & Lee

(57) ABSTRACT

An automatic label sticking device for automatically applying labels to a product such as an optical disc driver is provided. The automatic label sticking device includes a transport mechanism; a paper-peeling mechanism located above a fixed position; and, a paper-sticking mechanism spaced from a portion of the paper-peeling mechanism. The paper-peeling mechanism includes a main roller and a secondary roller disposed between paper feeding and recycling reels for guiding a label tape through a winding path. The main and secondary rollers are positioned such that they frictionally capture a portion of the label tape therebetween, to advance it along the winding path. The main roller is driven to rotate by a driving device, while the secondary roller is indirectly rotated to turn the recycling reel responsive to a driving force frictionally transmitted thereto through the captured portion of the label tape.

11 Claims, 4 Drawing Sheets

AUTOMATIC LABEL-STICKING DEVICE FOR OPTICAL DISC DRIVE

BACKGROUND OF THE INVENTION (a) Technical Field of the Invention

The present invention relates to an automatic label-sticking device for optical disc drive, and in particular, to a label-sticking device to label an adhesion label onto the surface of the optical disc drive products.

(b) Description of the Prior Art

Optical disc drives are widely used in audio-video and computer data devices as a means of pick-up broadcasting data and computer data. In order to provide instructions and product information of the optical disc drive product to the user, the manufacturing batch number, working voltage, working current, signal pins connection sequence and warning instructions are labeled at the housing of the product to allow the user to connect the device and to instruct the operation thereof Conventionally, the label-sticking of the optical disc drive product are done manually. There are numerous drawbacks such as the complicated process of peeling the labels, and sticking of the labels to the products, and the recycling of the blank paper type. Other than the requirement of time, manpower and capital, the adhered labels are not secured and are normally dislocated therefrom, or the labeling alignment to the product is not upright, and the labeling is not flat or in a wrong direction. It is rather common that the labels are peeled off again to proceed with another sticking step. The peeling off of this adhered labels is rather time, manpower and capital consuming. Accordingly, these drawbacks are imperatively to be solved by the optical disc drives manufacturers.

SUMMARY OF THE INVENTION

Accordingly, it is an object of the present invention to provide an automatic label-sticking device for optical disc drive, comprising an automatic transport mechanism, a paper-peeling mechanism, and a paper-peeling mechanism, which can automatically the peeling off, adhesion of labels onto the optical disc drive and recycle blank paper so as to greatly reduce working time, manpower and production cost.

Yet another object of the present invention is to provide an automatic label-sticking device for optical disc drive, wherein during the sticking process, the transport mechanism and the paper-sticking mechanism allow the label on the optical disc drive to be more secured, precise and flat, which can totally mitigate the drawbacks of manual sticking labels onto the optical disc drive.

One aspect of the present invention is to provide an automatic label sticking device for optical disc drive comprises a transport mechanism for transporting optical disc driver, at least one lateral side thereof being mounted with a sensor for sensing the optical disc driver and to station the ODD at a fixed position. A paper-peeling mechanism located above the fixed position of the ODD on the transport mechanism and including a paper-feeding reel and a recycling reel, the paper-feeding reel being wound with a roll of label tape having a plurality of adhesion labels denoting product series, and between the paper feeding reel and the recycling reel, a plurality of rollers, a main roller and a secondary roller being mounted so as to wind the label tape therebetween, forming into a tightly surround winding path, and the main roller being connected to a driving device, to be driven by the driving device, the secondary roller and the main roller contacted to each other to provide indirect driving and connectingly driving the recycling reel to rotate, the middle of the winding path being provided with a paper-peeling seat to horizontally peel off the adhesion labels of the label tape and recycling blank paper tape by the recycling reel, and a paper-sticking mechanism mounted at the top section of a fixed point station position of the optical disc drive and the external side of the paper-peeling seat of the paper-peeling mechanism, and having a pair of actuating rods having a terminal end mounted with a suction plate to suck the adhesion paper of the label dislocated from the paper-peeling seat of the paper-peeling mechanism and by the downward pressing of the actuating rod to cause the label adhesion paper adhered at a conveyor to stop at a fixed position of the optical disc drive surface.

Other object and advantages of the present invention will become more apparent from the following description taken in conjunction with the accompanying drawing.

DETAILED DESCRIPTION OF THE PREFERRED EMBODIMENT

Figure 1:
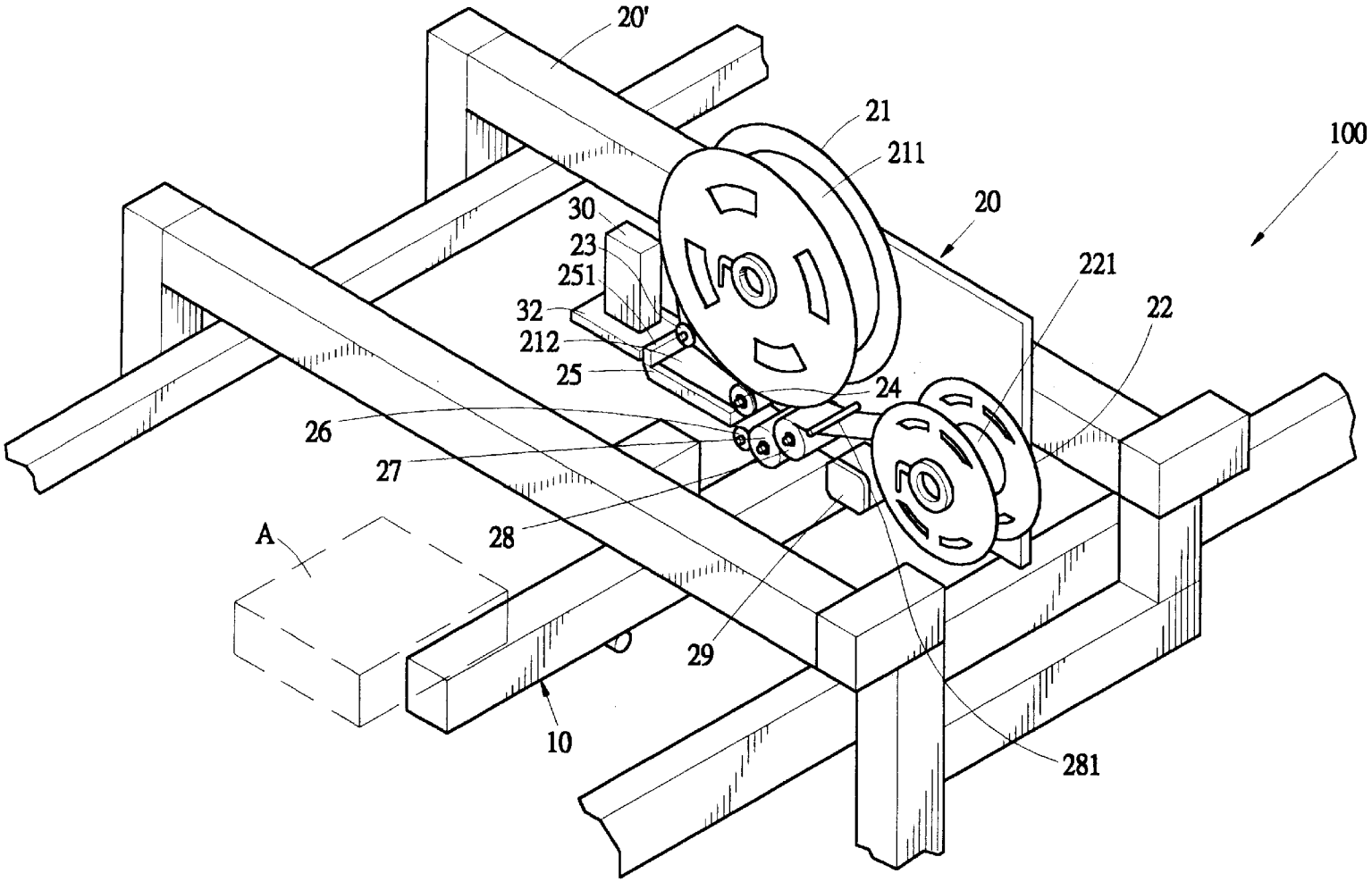
FIG. 1 is a perspective structural view of the present invention.
Figure 2:
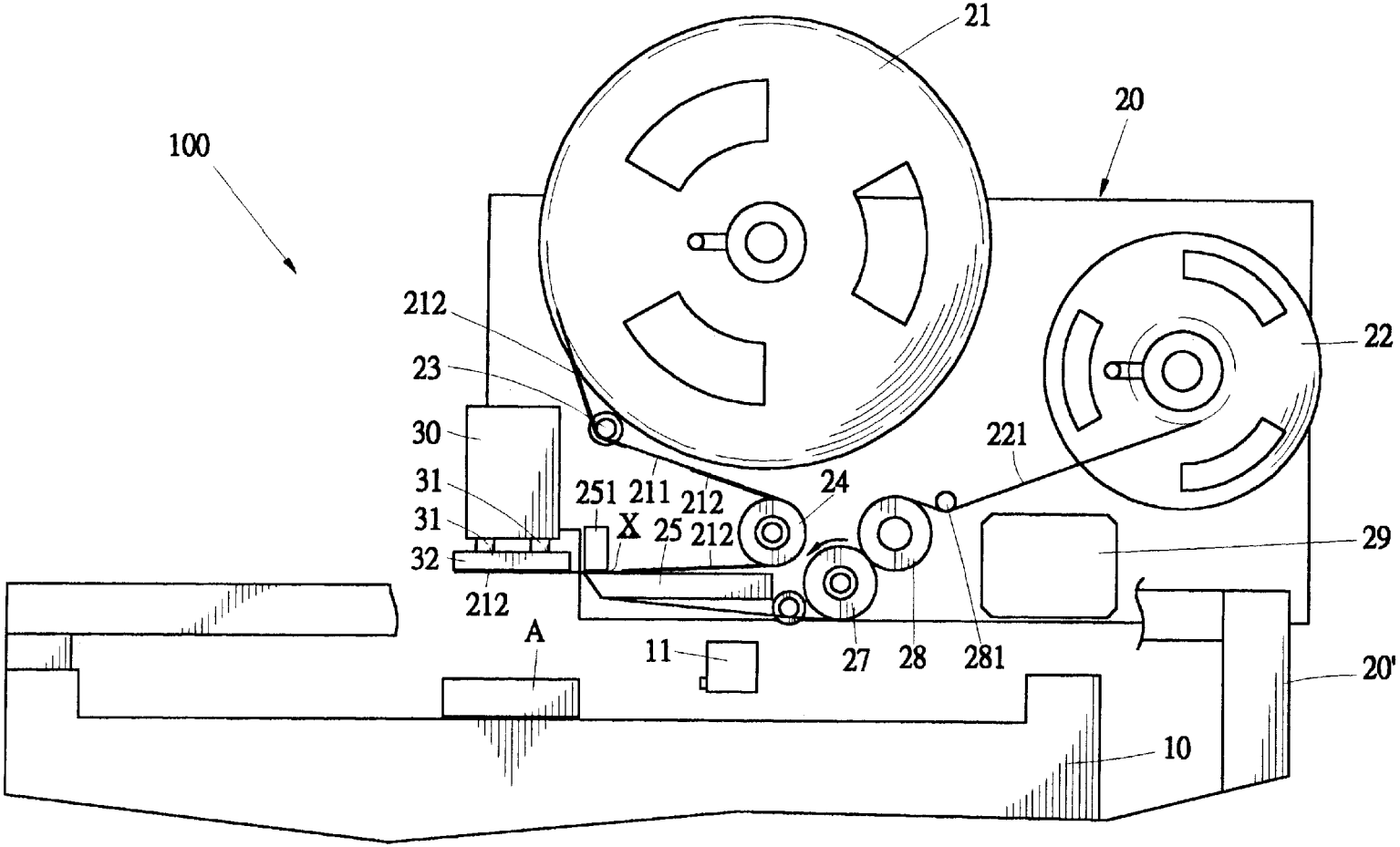
FIG. 2 is a front view showing the paper-peeling mechanism winding path and the label-peeling of the present invention.

First, referring to FIGS. 1 to 2, there is shown an automatic label-sticking device for optical disc drive denoted by reference number 100. The device 100 comprises a transport mechanism 10 to accommodate an optical disc drive A to be adhered with a label, providing a forward and a backward fixed track transporting of the optical disc drive A. At least one lateral side of the transport mechanism 10 is provided with a sensor 11, either an opto-electric sensor or substantially sensor element to sense the fixed point position of the optical disc drive A and temporarily stop the transport mechanism 10 and let the optical disc drive A to stop at this fixed point position.

In accordance with the present invention, a paper-peeling mechanism 20 is located at the upper portion of the fixed point stationed position of optical disc drive A on the transport mechanism. In the present invention, a securing frame 20' is employed to support the mechanism. The paper-peeling mechanism 20 is provided with a paper-feeding reel 21 and a recycling reel 22. The paper-feeding reel 21 is wound around with a label tape 211. The surface thereof is provided with a plurality of labels 212 denoting product series (as shown in FIG. 2). On the recycling reel 22, a blank paper tape 221 is wounded thereto. At the bottom portion of the paper-feeding reel 21, a plurality of rollers 23, 24 are mounted. By first pulling out the label tape 211 to form a primary winding path, and at the bottom portion of the rollers 23, 24, a paper-peeling seat 25 is provided. The front end thereof is downwardly cut into a slope and the top portion of the front end is provided with a peel-off clipping block 251 and forms a gap x with the paper-peeling seat 25 to allow the label tape 211 after being wound around the roller 24 to pass through the gap x, thereby after the label 212 passed through the peel-off clipping block 251, it will move to the horizontal direction (as shown in FIG. 2) such that the label tape 211, after passes through the block 251, becomes blank paper tape 221.

In accordance with the present invention, a roller 26, a main roller 27, a secondary roller 28, an end terminal roller 281 are location between the paper-feeding reel 21 and the recycling reel 22 to allow the blank paper tape 221 to pass the rollers in sequence to form a wound path having one tightening end and finally, it is wound to the recycling reel 22. In accordance to the present preferred embodiment, the main roller 27 the secondary roller 28 are mutually contact and the blank paper 221 to surround therebetween such that the surface friction of the blank paper 221 with the surface of the main roller 27 and the secondary roller 28 forms into an indirect transmission relation.

Figure 3:
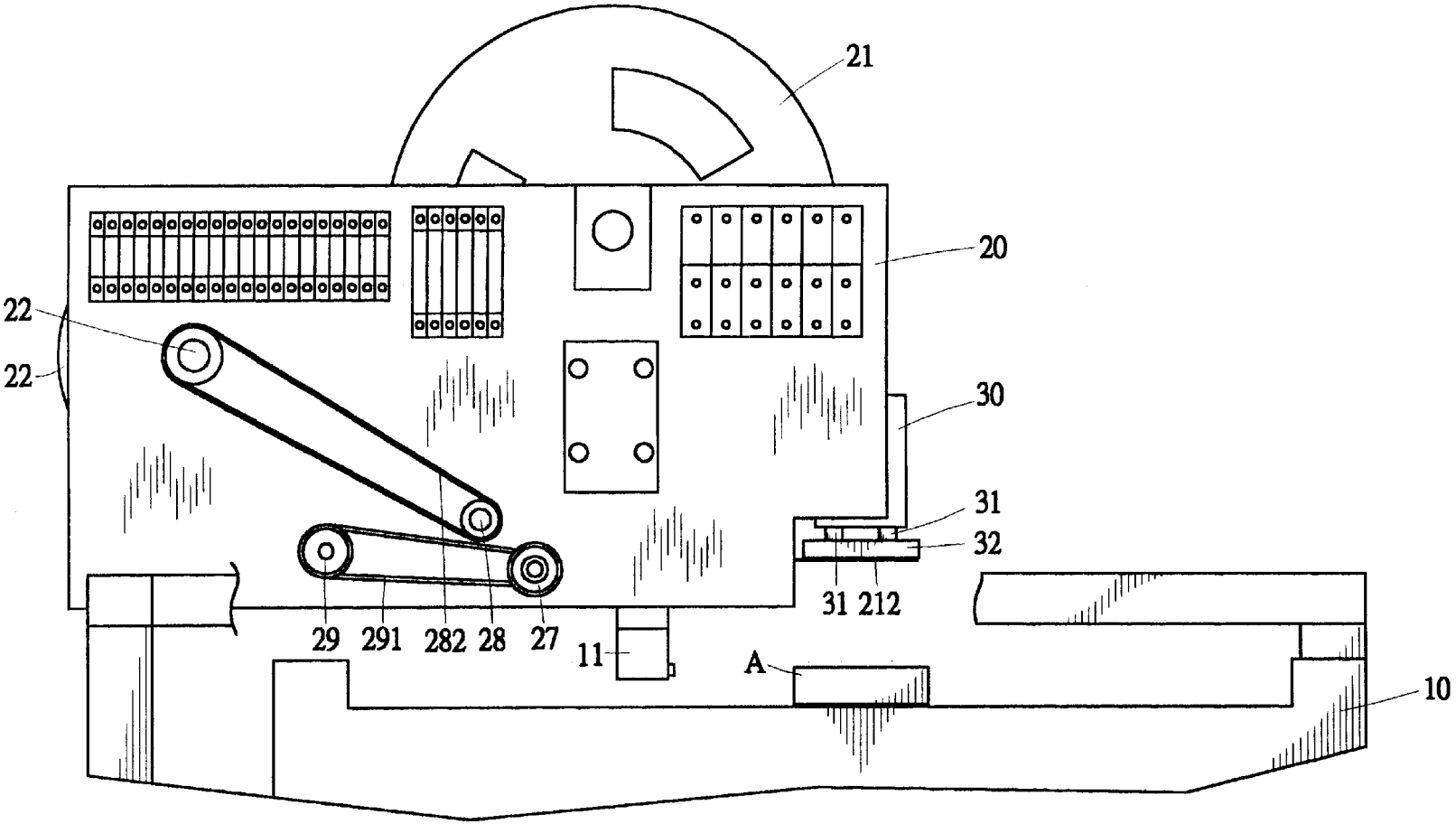
FIG. 3 is a rear view showing the driving device, the power transmission structure between the paper-feeding reel and the recycling reel.

Referring to FIG. 3, the above paper-peeling mechanism 20 includes a driving device 29. In the present preferred embodiment, a servo-motor is used, and a belt 291 connects the servo-motor with the main roller 27 such that the main roller 27 is driven by the driving device 29 to rotate. The momentum of the rotation is determined by the length of the adhesion labels 212 of the label tape 211, and the secondary roller 28 is also rotated by the main roller 27 indirectly. A belt 282 connects the secondary roller 28 and the recycling reel 22 such that the recycling reel 22 rotates the recycling of the blank paper 221 as a result of the rotation of the secondary roller.

The paper-sticking mechanism 30 is mounted at the top section of a fixed point stationed position of the optical disc drive A of the transport mechanism 10 and at the external side of the paper-peeling seat 25 of the paper-peeling mechanism 20. In accordance with the present invention, a pneumatic cylinder is employed, wherein the cylinder is provided with a pain of actuating rod 31 which can reciprocate up and down, and the moving distance is up to the surface of the housing of the optical disc drive at the transport mechanism 10. The end terminal of the actuating rod 31 is provided with a suction disc 32. The peel-off clipping block 251 of the paper-peeling mechanism 20 leads the label 212 to be rapidly dislocate horizontally and the suction disc 32 adsorbs the labels 212 (as shown in FIG. 2). This action can be executed by the sensing elements mounted at the peel-off clipping block 251 and the suction disc (not shown) or by a calculation method of an automatic control sequence such that the labels 212 can be firmly and flatly adhered to the suction plate 32.

Figure 4:
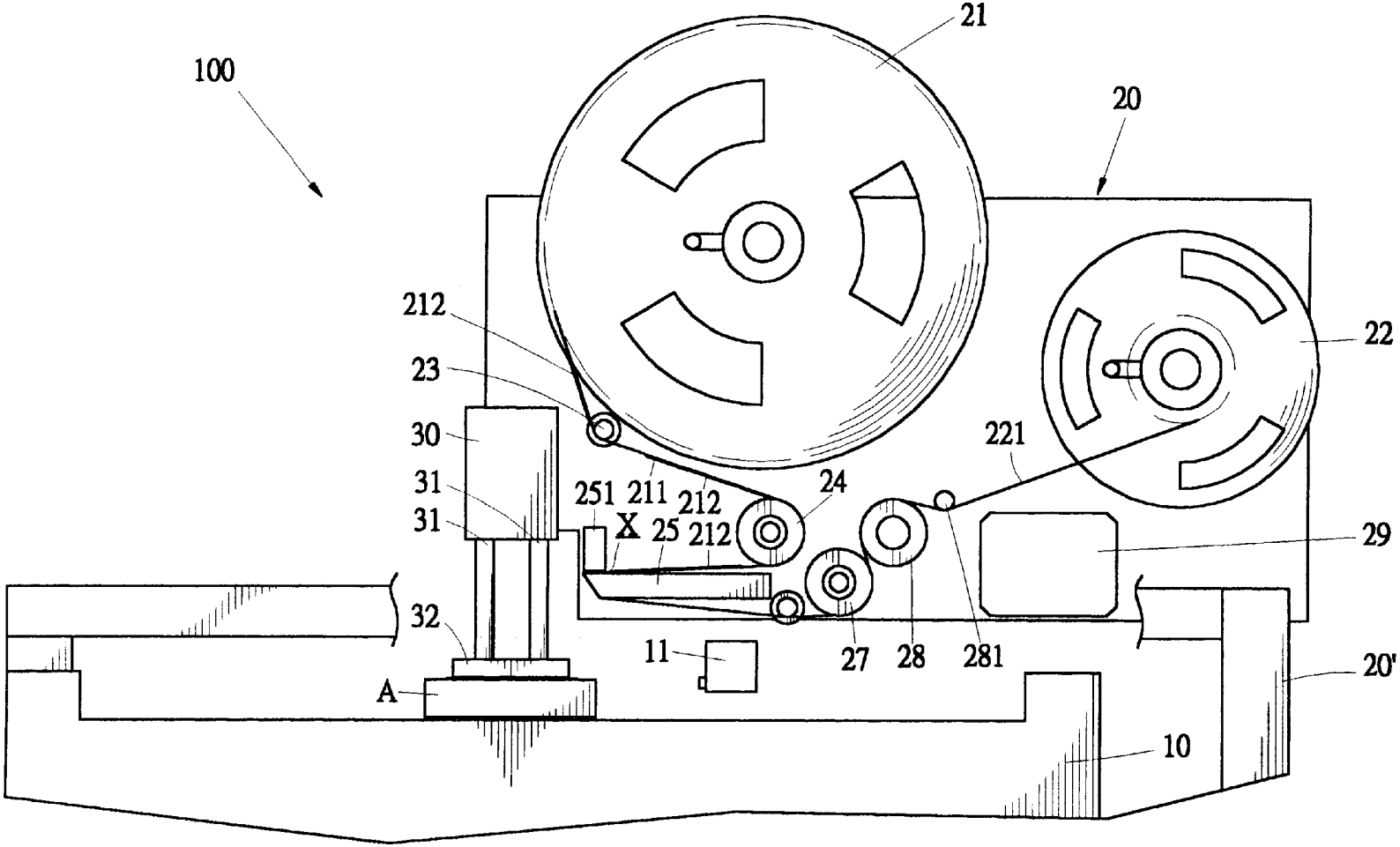
FIG. 4 is a front view illustrating the downward press of the sticking mechanism onto labels on the housing of the optical disc drive in accordance with the present invention.

Referring to FIG. 4, there is shown an automatic label-sticking device for optical disc drive 100. During sticking labels onto the surface of the optical disc drive A, the optical disc drive A on the transport mechanism 10 is transported and is detected by the sensor 11 that the drive A is at the fixed-point position, the driving device 29 of the paper-peeling mechanism 20 drives the main roller 27 (indicated by the arrow in FIG. 4). By means of the frictional force between the main roller 27 and the blank paper tape 221, the label tape 211 located on the paper-feeding reel 21 is pulled and fed paper to the peel-off clipping block 251 of the paper-peeling seat 25. Then, by means of the front end downward sloping shape of the paper-feeding seat 25, the label 212 is peeled-off from the label tape 211 and in combination with the peel-off clipping block 251 the dislocating track of the label is fixed in a horizontal direction, and is sucked by the suction plate 32 of the paper-sticking mechanism 30. By means of the downward press of the actuating rod 31, the label 212 can flatly and precisely adhered onto the surface of the housing of the optical disc drive A on the transport mechanism 10. When the suction of the suction plate 32 is released, the actuating rod 31 will restore to its original position. When the main roller 27 rotates, the secondary roller 28 is driven to rotate by the main roller 27, and the recycling reel 22 will wind the blank paper tape 221 as a result of the rotation of the secondary roller 28. That is, this action helps to pull the label tape 211 of the paper-feeding reel 21.

Accordingly, by means of repeating action of the transport mechanism 10, the paper-peeling mechanism 20 and the paper-sticking mechanism 30, the housing surface of the optical disc drive A on the transport mechanism 10 can be automatically adhere with labels 212. The objective of the present invention to automatically stick labels onto the optical disc drives is achieved. The action of the elements, such as the transport mechanism 10, the paper-feeding mechanism 20, and the paper-sticking sticking mechanism 30 are not restricted to certain mode of control with respect to sequence of action and mode of timing control. For instance, programmable controller or PC control interface may be used to control the automatic label-sticking device of the present invention.

In accordance with the present invention, the advantages of the present claimed label-sticking device are as follows:

1) The peeling-off and sticking process of the labels 212, and the recycling of the blank paper tape 221 process are fully automatic. Thus, the time, manpower and capital for product labeling of optical disc drives A p, in the manufacturing process are greatly reduced.
2) The sticking of labels 212 is secured, flat and precise which mitigates the drawbacks and errors made by manual sticking process.
3) The quality and the efficiency of the label-stick on the optical disc drive A process are greatly improved While the invention has been described with respect to preferred embodiment, it will be clear to those skilled in the art that modifications and improvements may be made to the invention without departing from the spirit and scope of the invention. Therefore, the invention is not to be limited by the specific illustrative embodiment, but only by the scope of the appended claims.

What is claimed is:

1. An automatic label sticking device comprising:

a) a transport mechanism for transporting a product to be labeled, the transport mechanism having at least one sensor for sensing the product, the transport mechanism positioning the product at a fixed position responsive to the sensor;

b) a paper-peeling mechanism located above the fixed position for the product on the transport mechanism and including a paper-feeding reel and a recycling reel, the paper-feeding reel being wound with a roll of label tape having a plurality of adhesion labels, at least a main roller and a secondary roller being disposed between the paper feeding reel and the recycling reel for guiding the label tape through a winding path, the main and secondary rollers frictionally capturing a portion of the label tape therebetween to advance the label tape along the winding path, the main roller being connected to a driving device to be driven thereby, the secondary roller being indirectly rotated responsive to a driving force frictionally transmitted thereto through the captured portion of the label tape, the recycling reel being connected for rotation responsive to the secondary roller, the middle of the winding path being provided with a paper-peeling seat for separating the adhesion labels from the label tape, the blank label tape thereafter being taken up by the recycling reel; and, c) a paper-sticking mechanism mounted at the top section of a fixed point station position of the product and spaced from the paper-peeling seat of the paper-peeling mechanism, the paper-sticking mechanism having a pair of actuating rods having a terminal end mounted with a suction plate to suck the adhesion paper of the label separated from the label tape by the paper-peeling seat of the paper-peeling mechanism, the downward pressing of the actuating rods attaching the label at a fixed position upon a surface of the product.

2. The automatic label sticking device as set forth in claim 1, wherein the transport mechanism is a conveyor belt.

3. The automatic label sticking device as set forth in claim 1, wherein the sensor of the transport mechanism is an opto-electric sensor element.

4. The automatic label sticking device as set forth in claim 1, wherein the sensor of the transport mechanism is substantially a sensing element.

5. The automatic label sticking device as set forth in claim 1, wherein the driving device of the paper-peeling mechanism is a servo-motor.

6. The automatic label sticking device as set forth in claim 1, wherein a belt is used to connect the driving force of the paper-peeling mechanism and the main roller.

7. The automatic label sticking device as set forth in claim 1, wherein a belt is used to connect the secondary roller of the paper-peeling mechanism and the recycling reel.

8. The automatic label sticking device as set forth in claim 1, wherein the paper-peeling seat front end of the paper-peeling mechanism has a downward sloping shape.

9. The automatic label sticking device as set forth in claim 1, the top section by the paper-peeling seat front end is provided with a peel-off clipping block to secure horizontally directed guidance of the adhesion label.

10. The automatic label sticking device as set forth in claim 9, wherein a gap is formed between the peeling-off clipping block and the paper-peeling seat to allow the label paper to pass through.

11. The automatic label sticking device as set forth in claim 1, wherein the paper-sticking mechanism includes a pneumatic cylinder.

* * * * *